US009345274B1

(12) United States Patent
Prill

(10) Patent No.: US 9,345,274 B1
(45) Date of Patent: May 24, 2016

(54) NURSING DEVICE

(71) Applicant: Christine Prill, Billings, MT (US)

(72) Inventor: Christine Prill, Billings, MT (US)

(73) Assignee: CMWP, LLC, Billings, MT (US)

( * ) Notice: Subject to any disclaimer, the term of this patent is extended or adjusted under 35 U.S.C. 154(b) by 0 days.

(21) Appl. No.: 14/667,095

(22) Filed: Mar. 24, 2015

Related U.S. Application Data

(63) Continuation of application No. 61/969,456, filed on Mar. 24, 2014.

(51) Int. Cl.
*A41C 3/12* (2006.01)
*A41C 3/04* (2006.01)

(52) U.S. Cl.
CPC .... *A41C 3/04* (2013.01); *A41C 3/12* (2013.01)

(58) Field of Classification Search
CPC ..... A41C 3/00; A41C 1/00; A41B 9/16; A41F 1/00; A41F 1/002; A41F 1/006; A41F 1/02; A41F 1/04; A41F 15/00; A41F 15/002; A41F 15/005; A41F 15/02; A41F 18/00; A41F 19/00
USPC ..... 450/86, 36
See application file for complete search history.

(56) References Cited

U.S. PATENT DOCUMENTS

| | | | | |
|---|---|---|---|---|
| 2,063,104 | A * | 12/1936 | Kibbe | 450/86 |
| 4,878,879 | A * | 11/1989 | Kunstadter | 450/36 |
| 6,427,244 | B1 * | 8/2002 | Speier et al. | 2/104 |
| 7,314,400 | B2 * | 1/2008 | Fildan et al. | 450/86 |
| 7,513,816 | B1 * | 4/2009 | McCullough et al. | 450/86 |
| 7,819,721 | B1 * | 10/2010 | Messier | 450/86 |
| 8,075,369 | B2 * | 12/2011 | Hendrickson | 450/86 |
| 2002/0022439 | A1 * | 2/2002 | Robinson | 451/56 |
| 2003/0159195 | A1 * | 8/2003 | Yachimec et al. | 2/104 |
| 2009/0047867 | A1 * | 2/2009 | Morello | 450/88 |
| 2010/0173564 | A1 * | 7/2010 | Michael | 450/86 |

* cited by examiner

*Primary Examiner* — Gloria Hale
(74) *Attorney, Agent, or Firm* — Kutak Rock LLP; Sean P. Connolly

(57) ABSTRACT

A nursing device generally includes a strap having a first end and a second end. The first end may be permanently attached to a nursing garment and the second end provided with means for being removably attached to the nursing garment. The strap may thus be wrapped at least partially about a portion of the outer garment and retain it in a position that facilitates nursing.

2 Claims, 5 Drawing Sheets

NURSING DEVICE

CROSS-REFERENCE TO RELATED APPLICATIONS

This application claims priority pursuant to 35 U.S.C. 119 (e) to U.S. Provisional Patent Application Ser. No. 61/969,456, filed Mar. 24, 2014, the entire disclosure of which is incorporated herein by reference.

FIELD

This invention relates to wear apparel for women, and more particularly to a nursing garment and nursing garment accessories for a mother.

BACKGROUND

A variety of nursing garments for women have been devised. Typically, such garments have utilized fasteners of some sort to temporarily release or remove a portion of the garment and thereby provide the baby access to its mother's breast. Unaddressed, however, is the outer garment being worn by the mother.

The outer garment may be any of a variety of shirts or blouses including sweatshirts, button-downs, sweaters, tee-shirts, or other tops. The outer garment may obstruct the child's access to the breast and must be held away from the breast. This may require the mother to use one arm to hold the child while using the other to hold the outer garment. Mothers may also retain the outer garment by pinching it between their chin and shoulder or performing other contortions. All such ways of retaining the outer garment are made even more complicated in the case of a younger child, such as a newborn, who requires more support while nursing.

Accordingly, an object of the present disclosure is to provide a device for restraining the outer garment worn by a nursing mother while she nurses. Another object of the present disclosure is to provide an improved nursing garment, such as a nursing bra, having means for retaining the outer garment to facilitate nursing.

SUMMARY

The nursing device generally includes a strap having a first end and a second end. The first end may be permanently attached to a nursing garment and the second end provided with means for being removably attached to the nursing garment. The strap may thus be wrapped at least partially about a portion of the outer garment and retain it in a position that facilitates nursing.

Other embodiments relate to a nursing bra comprising an under band and a shoulder strap having a first end and a second end, the first end having a fastener and the second end being coupled to the under band at a back of the bra. A cup extends from the under band to a position proximate the first end of the shoulder strap and includes a fastener positioned at an apex. The fastener configured to couple the cup to the shoulder strap. An under strap is provided extending from the first end of the shoulder strap to the under band. A garment retaining strap extends from a first end at the under band, the under strap, or a point where the under band is coupled to the under strap, the garment retaining strap having a second end coupled to a fastener configured to couple the second end of the garment retaining strap to the shoulder strap. The garment retaining strap is generally positioned between the cup and the under strap when the apex of the cup is coupled to the shoulder strap.

Other objects, advantages and features of the invention will become apparent from the following detailed description of one embodiment thereof, presented in conjunction with the accompanying drawing.

DETAILED DESCRIPTION

Figure 2:
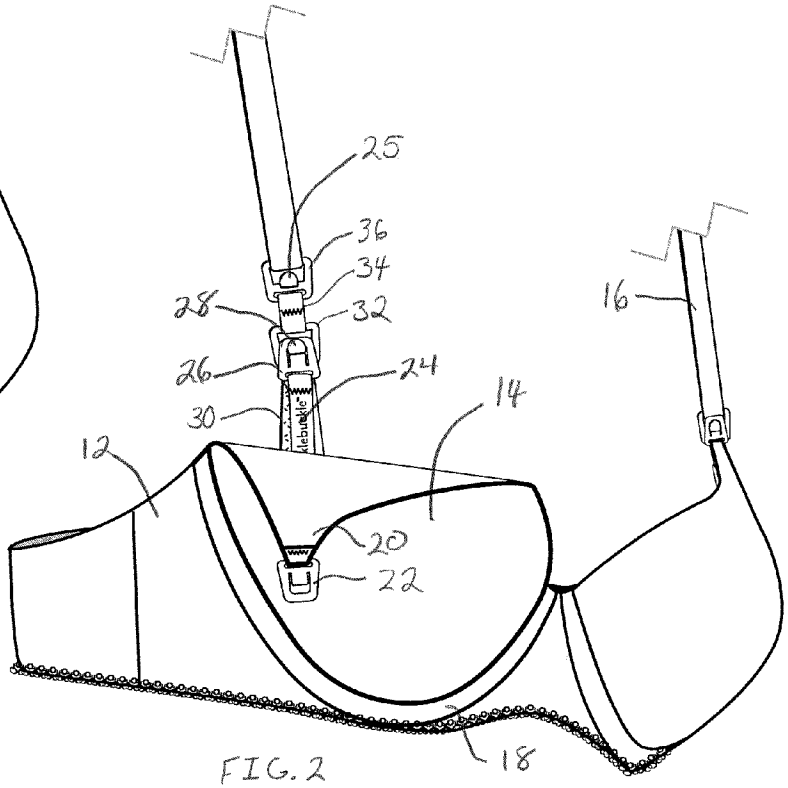
FIG. 2 is another perspective view of the improved nursing bra of FIG. 1.
Figure 1:
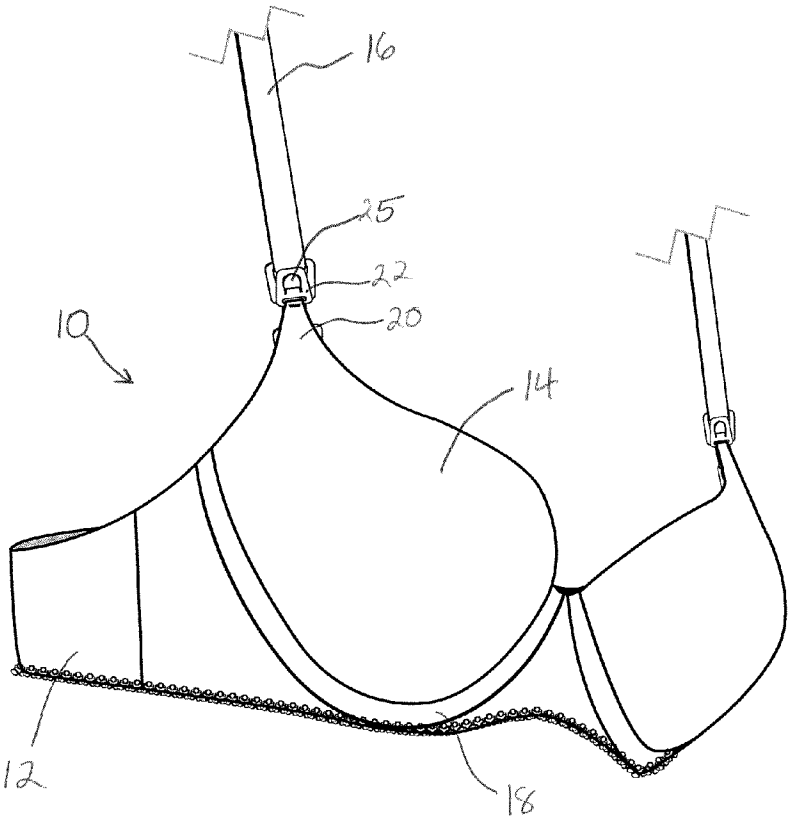
FIG. 1 is a perspective view of an improved nursing bra.

Referring to FIGS. 1-5, an improved nursing bra may incorporate a garment retaining device. While a nursing bra is shown, the device may be used with similar garments including nursing tank tops, etc. The nursing bra 10 may include an under band 12, cups 14, and shoulder straps 16 which extend from an apex of each cup 14 to a rear area of under band 12. In some embodiments, the under band 12 may be closeable at either the rear or between cups 14 by clips, clasps or other means. Cup 14 is shown as coupled to under band 12 proximate to piping 18 which extend along a curve and may, in some embodiments, contain a wire support. Cup 14 extends generally upward from piping 18 to an apex 20 where fastener 22, shown as a loop, removably couples cup 14 to shoulder strap 16 at fastener 25, shown as a post.

Figure 3:
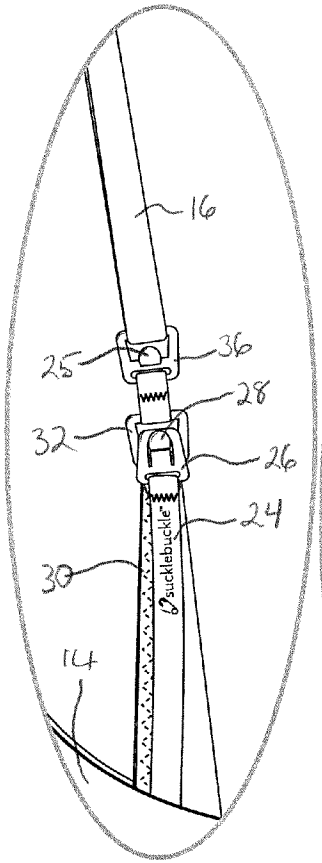
FIG. 3 is an enlarged perspective view of a portion of the improved nursing bra of FIG. 1.

As shown in FIGS. 2-3, cup 14 may be unfastened from shoulder strap 16 by lifting disconnecting fastener 22 from fastener 25. This allows cup 14 to fold downwardly to facilitate nursing of a child. When cup 14 is folded down, the garment retaining device may be seen. The garment retaining device includes a strap 26, which may be fixedly coupled proximate to piping 18 by means of stitching and extend upwardly where it terminates at fastener 26 which is shown as a loop. Strap 24 may be retained by coupling fastener 26 to fastener 28, shown as a post. Under strap 30 may generally extend from coupler 32 to a point proximate to piping 18 where it may be fixedly coupled to the under band by stitching. Coupler 32 links under strap 30 to shoulder strap 16 by way of strap segment 34 and coupler 36.

Figure 5:
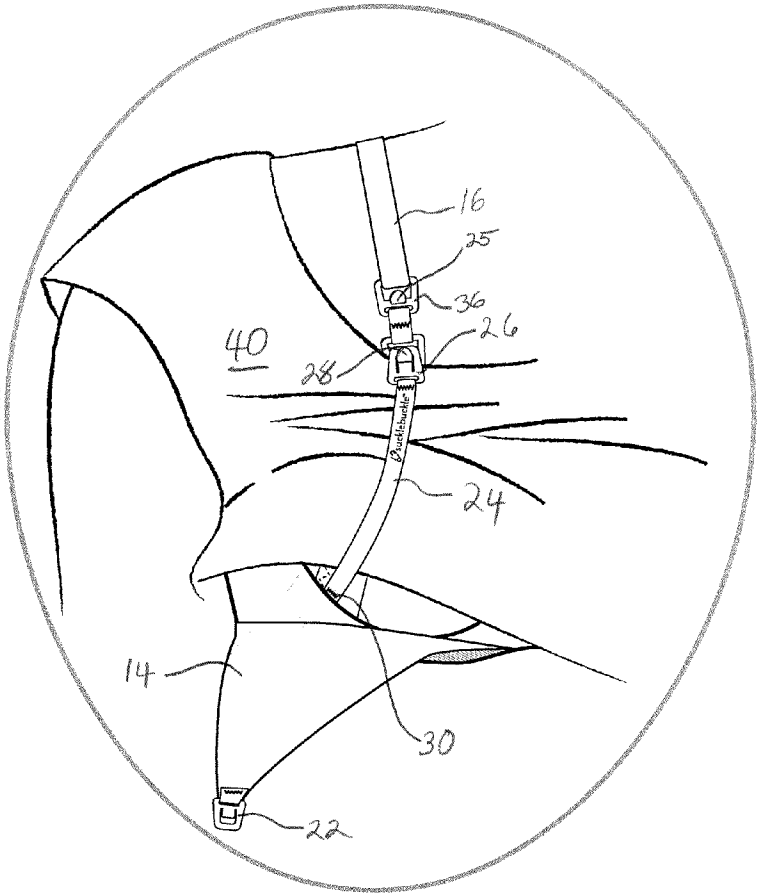
FIG. 5 is a partial elevation view of the improved nursing bra of FIG. 1 shown retaining a garment.
Figure 4:
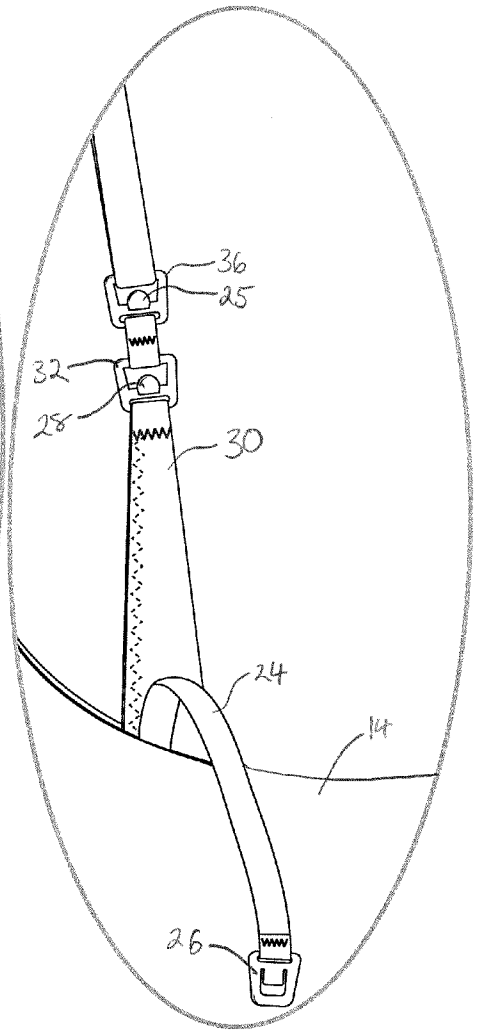
FIG. 4 is another enlarged perspective of a portion of the improved nursing bra of FIG. 1.

As shown in FIG. 4, strap 24 may be released by unfastening fastener 26 from fastener 28. Once released, strap 24 may be folded downwardly towards piping 18 outside of cup 14. As shown in FIG. 5, an outer garment worn by a user over nursing bra 10 may be lifted and retained above the bottom of under band 12 by bringing strap 24 under a the outer garment 40, forward of the user, over outer garment 40 and then recoupling strap 14 to shoulder strap 16 by connecting fastener 26 to fastener 28. Outer garment 40 in thereby retained between strap 24 and under strap 30 and above the bottom of under band 12 to give the user, a nursing mother, a way to keep her outer garment out of the way while having both hands free to hold the nursing child.

Figure 7:
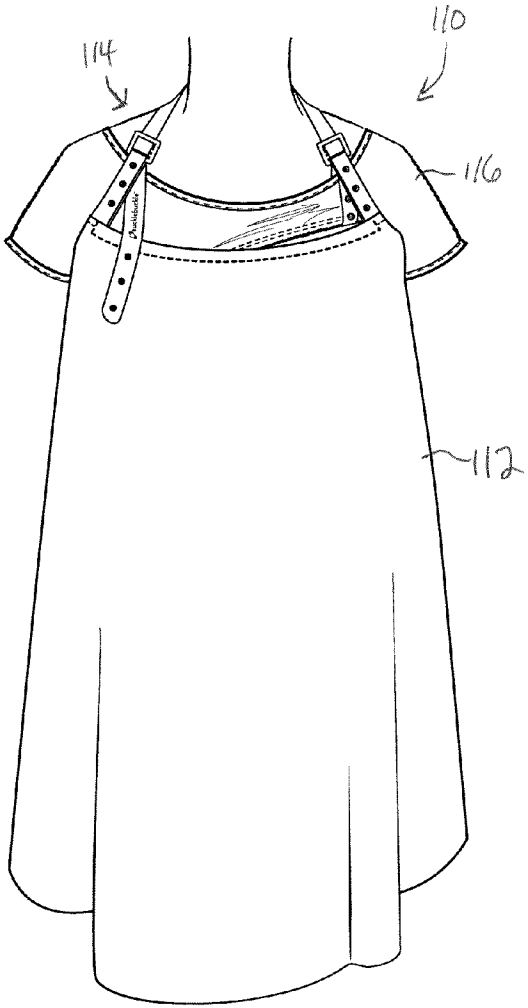
FIG. 7 is another elevation view of the nursing apron of FIG. 6.
Figure 6:
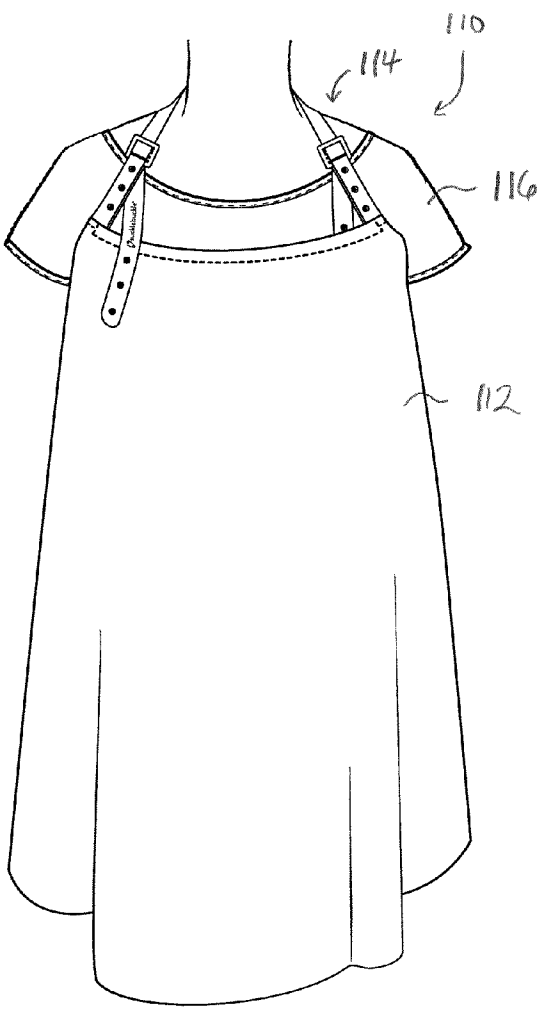
FIG. 6 is an elevation view of a nursing apron with a garment retention device.

Referring to FIGS. 6 and 7, a nursing apron 110 may include a cover 112 that at least partially covers the mother's shirt, blouse or other top 116. A neck strap 114 may extend from the top of cover 112 at one side to the other side of the top edge of cover 112. FIG. 7 shows the nursing apron 110 of FIG. 6 being used to retain the mother's top 116 to facilitate nursing.

Figure 9:
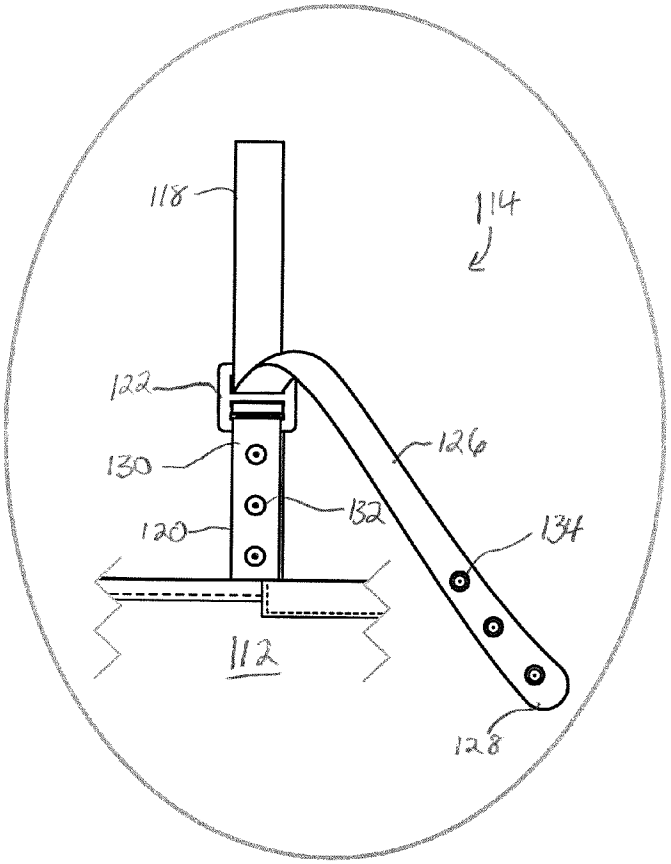
FIG. 9 is a partial rear elevation view of the nursing apron of FIG. 6.
Figure 8:
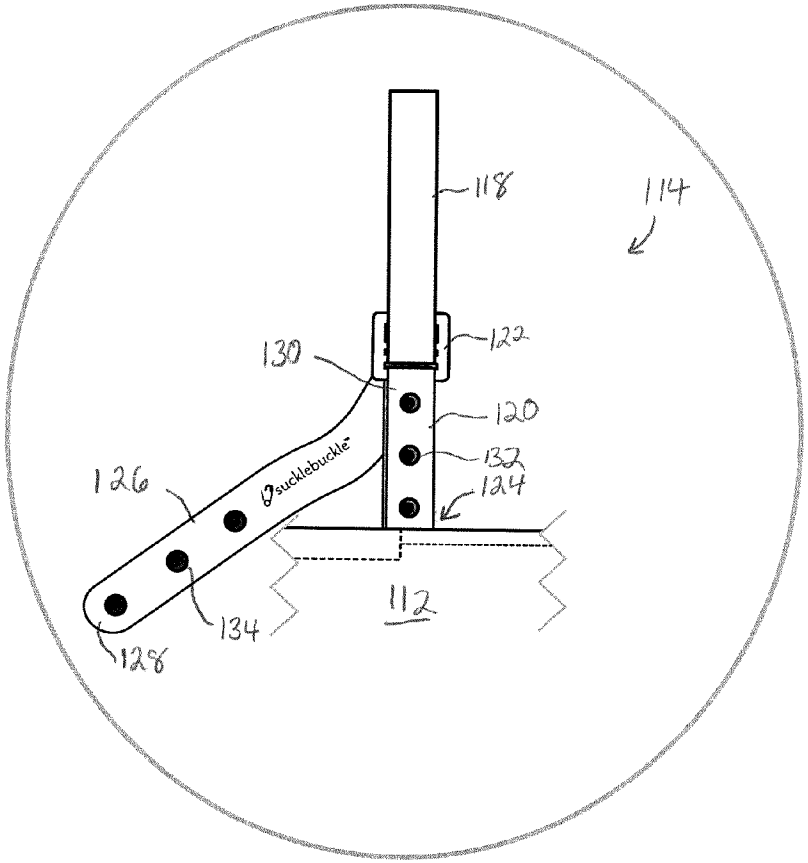
FIG. 8 is a partial front elevation view of the nursing apron of FIG. 6.

FIGS. 8 and 9 show one of the ends of neck strap 114 in greater detail with FIG. 8 providing a front view and FIG. 9 providing a rear view. As shown, neck strap 114 includes a main strap segment 118 extending from a coupler 122 to another coupler (not shown) at the other end. Coupler 122 is shown as a tri glide, bot other similar couplers may be used including releasing clasps and the like to facilitate donning and removal of nursing apron 110. As shown, segment 120 extends from a point 124 proximate the top edge of cover 112 to coupler 122. Segment 126 extends from coupler 122, behind segment 120 and terminates at end 128.

Segment 120 includes a fastener area 130 on which fasteners 132, shown as female snap halves, are positioned. Fasteners 134 are positioned on segment 126 proximate to end 128 and are complimentary to fasteners 132 and are shown as male snap halves. As shown in FIG. 7, Segment 126 may be looped under top 116, under a bottom edge of top 116, and up to segment 120 where fasteners 132 and 134 may be used to removeably couple segment 126 to segment 120. This configuration creates a loop in which top 116 may be retained while a child nurses under cover 112.

Figure 11:
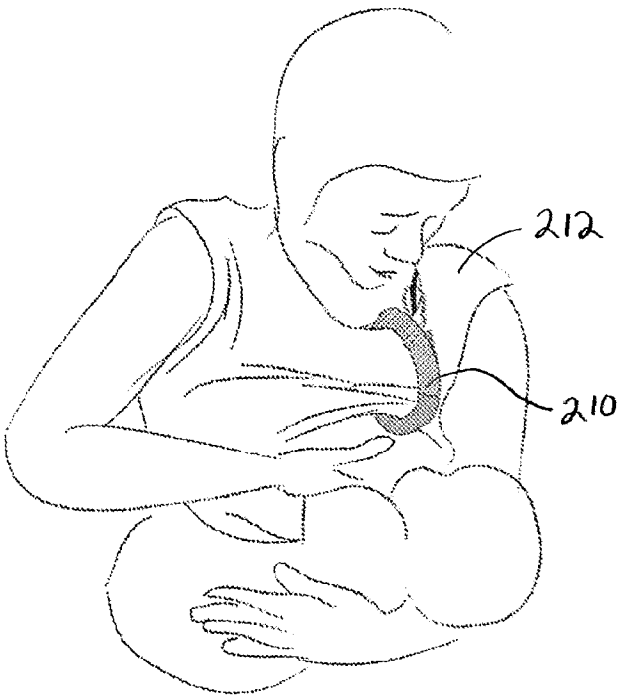
FIG. 11 is a schematic view of the garment retaining device of FIG. 10 in use.
Figure 10:
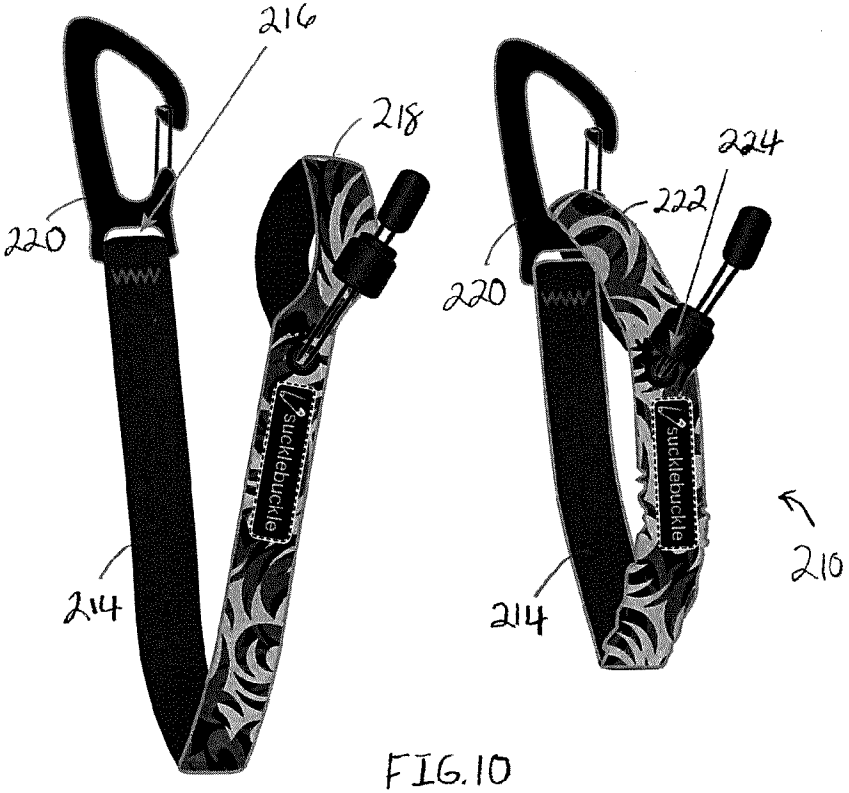
FIG. 10 is an elevation view of a garment retaining device.

Referring to FIGS. 10 and 11, the device 210 may, in some embodiments, be a stand-alone device for use with a conventional nursing bra or other garment 212. The device includes a strap 214 having a first end 216 and a second end 218. A hook, clip, clasp, or other fastener 220 (including an opening loop of the strap) may be provided at the first end 216 for attachment to a shoulder strap of a nursing bra or, in the case of use to retain an outer garment without a nursing bra, to the second end 218. Another fastener 222 (complimentary to fastener 220), an opening, or a loop may be provided at the second end. In use, the first end 216 of strap 214 may run from the shoulder strap of the nursing bra, under the outer garment and in front of the outer garment. The second end 218 may then be secured at a point proximate to the first end 216, the bra strap, or other component to provide a loop that retains the outer garment above the area where the child would access the breast. An adjustment element 224 is included and allows the mother to adjust the overall length of strap 214 and thereby the size of the loop used to retain a garment. This allows the mother to select the loop size that will be effective for the garment to be retained.

In some embodiments, the second end may include a clip, a closed loop for coupling with the fastener at the first end, magnets or hook-and-loop material for forming a loop around the first end or the bra strap, or other suitable means for coupling the second end to a point proximate the first end.

In some embodiments, the strap may be adjustable in length to accommodate a variety of outer garments and/or adjust the position at which the outer garment. Such adjustability may be accomplished by one or more cord or slides positioned interior of the strap being anchored at a first position, and exiting the interior of the strap at a second position. The cord may be a shock cord and may be provided with a sliding retainer that may be used to cinch up the strap thus making it shorter. Alternatively, one or more sliding buckles, tri-glides, or other devices may be used to provide an adjustable strap.

In some embodiments, the first end of the strap may be directly secured to the nursing garment at the shoulder strap. This provides a single nursing garment with an integrated device for retaining an outer garment. In some such embodiments the strap may be coupled to the nursing garment at the first end of the strap.

The magnets may be positioned on or in the strap at the first end and second end of the strap to facilitate easy coupling of the two ends with one hand. In some embodiments, multiple magnets may be spaced along the strap at increasing distances from the second end to allow for the size of the loop formed by the strap about the outer garment. Similarly, hook-and-loop material may be provided at or near the first and second ends.

In other embodiments, the strap may be coupled to the nursing garment at a point between the first end and the second end of the strap. This, in effect, provides two straps. One, terminating at the second end, may be routed under and around the outer garment as before, while the other, terminating at the first end, may pass through a neck opening of the outer garment where it can be coupled to the second end. In such embodiments, one or both of the strap portions may be adjustable in length.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

The terminology used in the description herein is for the purpose of describing particular embodiments only and is not intended to be limiting of the invention. As used in the description of the embodiments and the appended claims, the singular forms "a", "an" and "the" are intended to include the plural forms as well, unless the context clearly indicates otherwise.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that relative terms are intended to encompass different orientations of the device in addition to the orientation depicted in the Figures.

Moreover, it will be understood that although the terms first and second are used herein to describe various features, elements, regions, layers and/or sections, these features, elements, regions, layers and/or sections should not be limited by these terms. These terms are only used to distinguish one feature, element, region, layer or section from another feature, element, region, layer or section. Thus, a first feature, element, region, layer or section discussed below could be termed a second feature, element, region, layer or section, and similarly, a second without departing from the teachings of the present invention.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The scope of the disclosure is not intended to be limited to the embodiments shown herein, but is to be accorded the full scope consistent with the claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims.

What is claimed is:

1. A nursing garment and a nursing garment accessory in combination, the combination comprising:

the nursing garment including a cup, an under strap, and a shoulder strap;

the nursing garment accessory including a retaining strap coupled to the nursing garment under the cup, the retaining strap having a first end and a second end;

a fastener coupled to the second end of the retaining strap;

wherein the retaining strap is configured to form at least a partial loop to at least partially retain an outer garment worn with the nursing garment.

2. A nursing bra comprising:

an under band;

a shoulder strap having a first end and a second end, the first end having a fastener and the second end being coupled to the under band at a back of the bra;

a cup extending from the under band to a position proximate the first end of the shoulder strap and having a fastener positioned at an apex and configured to couple the cup to the shoulder strap;

an under strap extending from the first end of the shoulder strap to the under band; and an outer garment retaining strap having a first end and a second end, the outer garment retaining strap extending from the first end positioned at the under band, the under strap between the under strap and the cup, or a point where the under band is coupled to the under strap;

wherein the second end of the outer garment retaining strap is coupled to a fastener configured to couple the second end of the outer garment retaining strap to the shoulder strap; and wherein the outer garment retaining strap is generally positioned between the cup and the under strap when the apex of the cup is coupled to the shoulder strap.

* * * * *